US010852654B2

(12) United States Patent
Terasaki

(10) Patent No.: US 10,852,654 B2
(45) Date of Patent: Dec. 1, 2020

(54) CARRIER AND TWO-COMPONENT DEVELOPER

(71) Applicant: KYOCERA Document Solutions Inc., Osaka (JP)

(72) Inventor: Kohei Terasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/674,185

(22) Filed: Nov. 5, 2019

(65) Prior Publication Data

US 2020/0159140 A1 May 21, 2020

(30) Foreign Application Priority Data

Nov. 21, 2018 (JP) ..... 2018-218091

(51) Int. Cl.
*G03G 9/00* (2006.01)
*G03G 9/113* (2006.01)

(52) U.S. Cl.
CPC ..... *G03G 9/1138* (2013.01); *G03G 9/1135* (2013.01); *G03G 9/1136* (2013.01)

(58) Field of Classification Search
CPC ... G03G 9/1138; G03G 9/1135; G03G 9/1136
USPC ..... 430/111.35
See application file for complete search history.

(56) References Cited

FOREIGN PATENT DOCUMENTS

JP 2009193016 A 8/2009

*Primary Examiner* — Mark A Chapman
(74) *Attorney, Agent, or Firm* — Studebaker & Brackett PC

(57) ABSTRACT

A carrier includes carrier particles. The carrier particles include first carrier particles and second carrier particles. The first carrier particles each include a first carrier core and a first coat layer covering a surface of the first carrier core. The second carrier particles each include a second carrier core and a second coat layer covering a surface of the second carrier core. The first coat layers contain no fatty acid metal salt. The second coat layer contains a coat layer binder resin and a fatty acid metal salt. The second coat layers contain the fatty acid metal salt in a proportion of from 85 mass % to 95 mass % relative to a total mass of the second coat layers. The second carrier particles are contained in a proportion of from 7 mass % to 15 mass % relative to a total mass of the first carrier particles and the second carrier particles.

6 Claims, 2 Drawing Sheets

CARRIER AND TWO-COMPONENT DEVELOPER

INCORPORATION BY REFERENCE

The present application claims priority under 35 U.S.C. § 119 to Japanese Patent Application No. 2018-218091, filed on Nov. 21, 2018. The contents of this application are incorporated herein by reference in their entirety.

BACKGROUND

The present disclosure relates to a carrier and a two-component developer.

A resin-coated carrier is known. Carrier particles included in the resin-coated carrier each include a carrier core and a resin layer (a coat layer) covering a surface of the carrier core. A two-component developer including a carrier and a toner is also known.

SUMMARY

A carrier according to an aspect of the present disclosure includes carrier particles. The carrier particles include first carrier particles and second carrier particles. The first carrier particles each include a first carrier core and a first coat layer covering a surface of the first carrier core. The second carrier particles each include a second carrier core and a second coat layer covering a surface of the second carrier core. The first coat layers contain no fatty acid metal salt. The second coat layers contain a coat layer binder resin and a fatty acid metal salt. The second coat layers contain the fatty acid metal salt in a proportion of at least 85% by mass and no greater than 95% by mass relative to a total mass of the second coat layers. The second carrier particles are contained in a proportion of at least 7% by mass and no greater than 15% by mass relative to a total mass of the first carrier particles and the second carrier particles.

A two-component developer according to another aspect of the present disclosure includes a toner including toner particles and the carrier according to the above-described aspect of the present disclosure.

DETAILED DESCRIPTION

Figure 1:
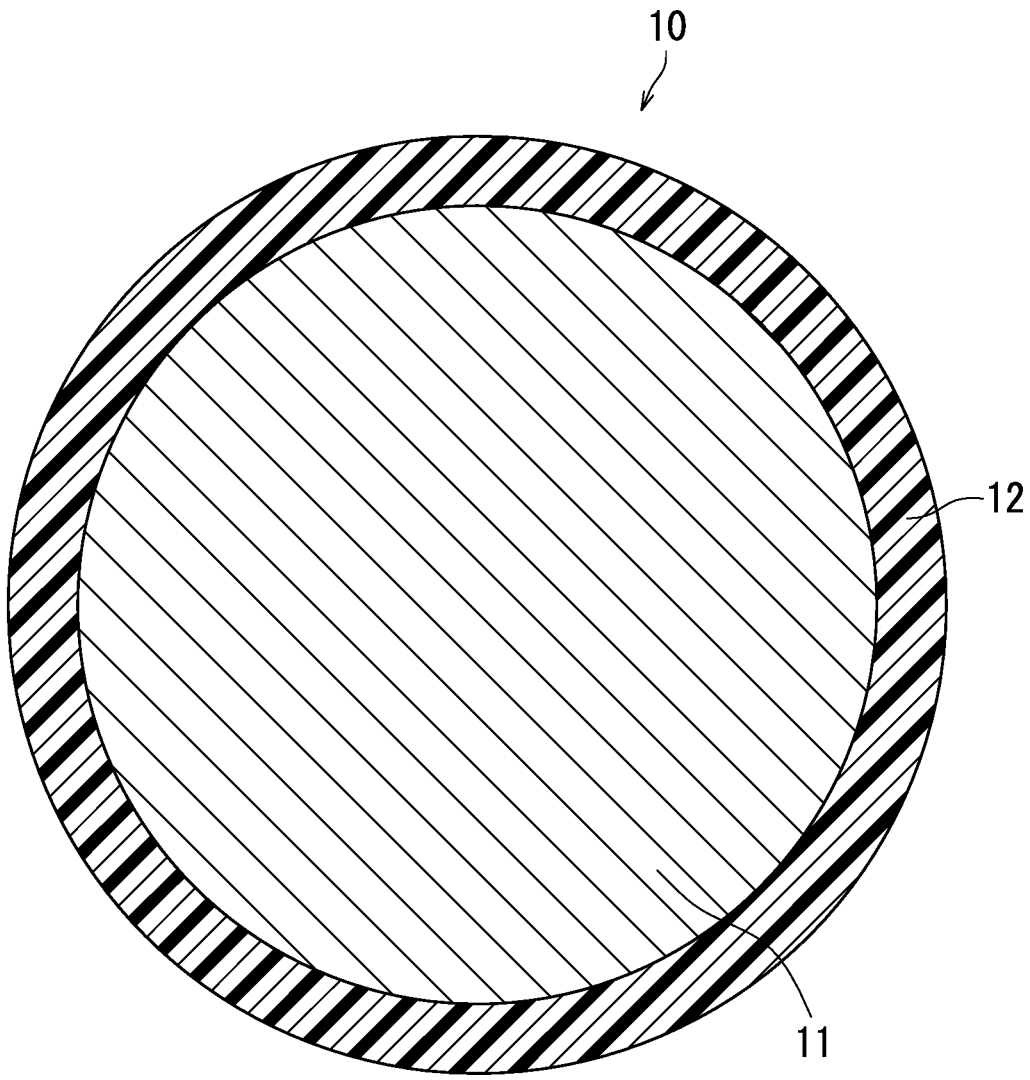
FIG. 1 is a diagram illustrating an example of a cross-sectional structure of a first carrier particle included in a carrier according to a first embodiment of the present disclosure.

The following describes preferred embodiments of the present disclosure. First, the terminology used in the present specification will be described. A carrier is a collection (for example, a powder) of carrier particles. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles and a powder of carrier particles) are each a number average of values measured for a suitable number of particles selected from the powder.

A value for volume median diameter ($D_{50}$) of a powder is a median of diameter by volume measured using a laser diffraction/scattering particle size distribution analyzer ("LA-950", product of Horiba, Ltd.), unless otherwise stated. A number average primary particle diameter of a powder is a number average of equivalent circle diameters of primary particles (Heywood diameter: diameters of circles having the same areas as projected areas of the primary particles) measured using a scanning electron microscope ("JSM-7401F", product of JEOL Ltd.), unless otherwise stated. A number average primary particle diameter of a power is a number average of equivalent circle diameters of, for example, 100 primary particles. Note that a number average primary particle diameter of particles refers to a number average primary particle diameter of particles in a powder (number average primary particle diameter of the powder), unless otherwise stated.

Chargeability refers to chargeability in triboelectric charging, unless otherwise stated. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after the triboelectric charging using for example a compact draw-off charge measurement system ("MODEL 212HS", product of TREK, INC.). A measurement target having a larger change in amount of charge before and after the triboelectric charging has stronger chargeability.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) plotted using a differential scanning calorimeter ("DSC-6220", product of Seiko Instruments Inc.), unless otherwise stated. Such an endothermic peak results from melting of a crystalline region. A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection caused due to glass transition (specifically, a temperature at an intersection point between an extrapolation of a base line and an extrapolation of an inclined portion of the curve) corresponds to the glass transition point (Tg).

First Embodiment: Carrier

A carrier according to a first embodiment of the present disclosure can be favorably used in development of electrostatic latent images. The carrier according to the first embodiment for example positively charges a toner through friction with the toner in a developing device.

The carrier according to the first embodiment includes carrier particles. The carrier particles include first carrier particles and second carrier particles. The first carrier particles each include a first carrier core and a first coat layer covering a surface of the first carrier core. The second carrier particles each include a second carrier core and a second coat layer covering a surface of the second carrier core. The first coat layers contain no fatty acid metal salt. The second coat layers contain a coat layer binder resin and a fatty acid metal salt. The second coat layers contain the fatty acid metal salt in a proportion of at least 85% by mass and no greater than 95% by mass relative to a total mass of the second coat layers. The second carrier particles are contained in a proportion of at least 7% by mass and no greater than 15% by mass relative to a total mass of the first carrier particles and the second carrier particles.

The proportion (unit: % by mass) of the fatty acid metal salt contained relative to the total mass of the second coat layers is also referred to below simply as a "fatty acid metal salt content". The proportion (unit: % by mass) of the second carrier particles contained relative to the total mass of the first carrier particles and the second carrier particles is also referred to below simply as a "second carrier particle content".

The carrier according to the first embodiment having the above-described composition can reduce a variation in amount of charge of the toner before and after printing on a large number of sheets (for example, 100,000 sheets) while suppressing occurrence of image flow (specifically, a phenomenon described as blurring of an image that looks as if the image was smeared). The reason for the above is thought to be as follows.

Since the second coat layers have a fatty acid metal salt content of at least 85% by mass, the second carrier particles included in the carrier according to the first embodiment restrict the ability of the carrier to charge the toner (toner charging ability) to a sufficiently low level. As a result, the amount of the toner carried by the second carrier particles in a developing device tends to be small. In a development process, therefore, the second coat layers of the second carrier particles carried on a developer bearing member (for example, a development sleeve) easily come in contact with an image bearing member (for example, a photosensitive drum). Consequently, a portion of the fatty acid metal salt in the second coat layers adheres to a surface of the image bearing member in the development process. The fatty acid metal salt has a hydrocarbon group, which is a hydrophobic group, and therefore the surface of the image bearing member having the fatty acid metal salt adhering thereto is inhibited from moisture absorption.

If the second coat layers have a too large fatty acid metal salt content, the fatty acid metal salt is easily escape from the second coat layers in the developing device, and therefore a supply of the fatty acid metal salt to the image bearing member tends to decrease. However, since the second coat layers of the carrier according to the first embodiment have a fatty acid metal salt content of no greater than 95% by mass, the fatty acid metal salt is inhibited from escaping from the second coat layers in the developing device. Furthermore, since the carrier according to the first embodiment has a second carrier particle content of at least 7% by mass, it is possible to supply, to the image bearing member, the fatty acid metal salt in an amount sufficient to inhibit the surface of the image bearing member from moisture absorption. Thus, the carrier according to the first embodiment can suppress occurrence of image flow resulting from moisture absorption in the surface of the image bearing member.

In the carrier according to the first embodiment, the fatty acid metal salt content is no greater than 95% by mass, and the second carrier particle content is no greater than 15% by mass. That is, the carrier according to the first embodiment has an upper limit of the fatty acid metal salt content and an upper limit of the second carrier particle content each set to a value that does not inhibit charging of the toner in printing on a large number of sheets (for example, 100,000 sheets). Thus, the carrier according to the first embodiment has toner charging ability that does not easily decrease even in printing on a large number of sheets and is able to reduce the variation in amount of charge of the toner before and after the printing on a large number of sheets.

The following describes the carrier according to the first embodiment in detail with reference to the accompanying drawings as appropriate. Note that the drawings schematically illustrate elements of configuration in order to facilitate understanding, and properties of elements of configuration illustrated in the drawings, such as size, number, and shape thereof, may differ from actual properties thereof in order to facilitate preparation of the drawings.

[Composition of Carrier Particles]

The carrier particles in the carrier according to the first embodiment include the first carrier particles and the second carrier particles. The carrier according to the first embodiment may further include carrier particles other than the first carrier particles and the second carrier particles. However, in order to further reduce the variation in amount of charge of the toner before and after printing on a large number of sheets while further suppressing occurrence of image flow, a total of the proportion of the first carrier particles and the proportion of the second carrier particles is preferably at least 90% by mass relative to a total mass of the carrier particles, and more preferably 100% by mass.

Figure 2:
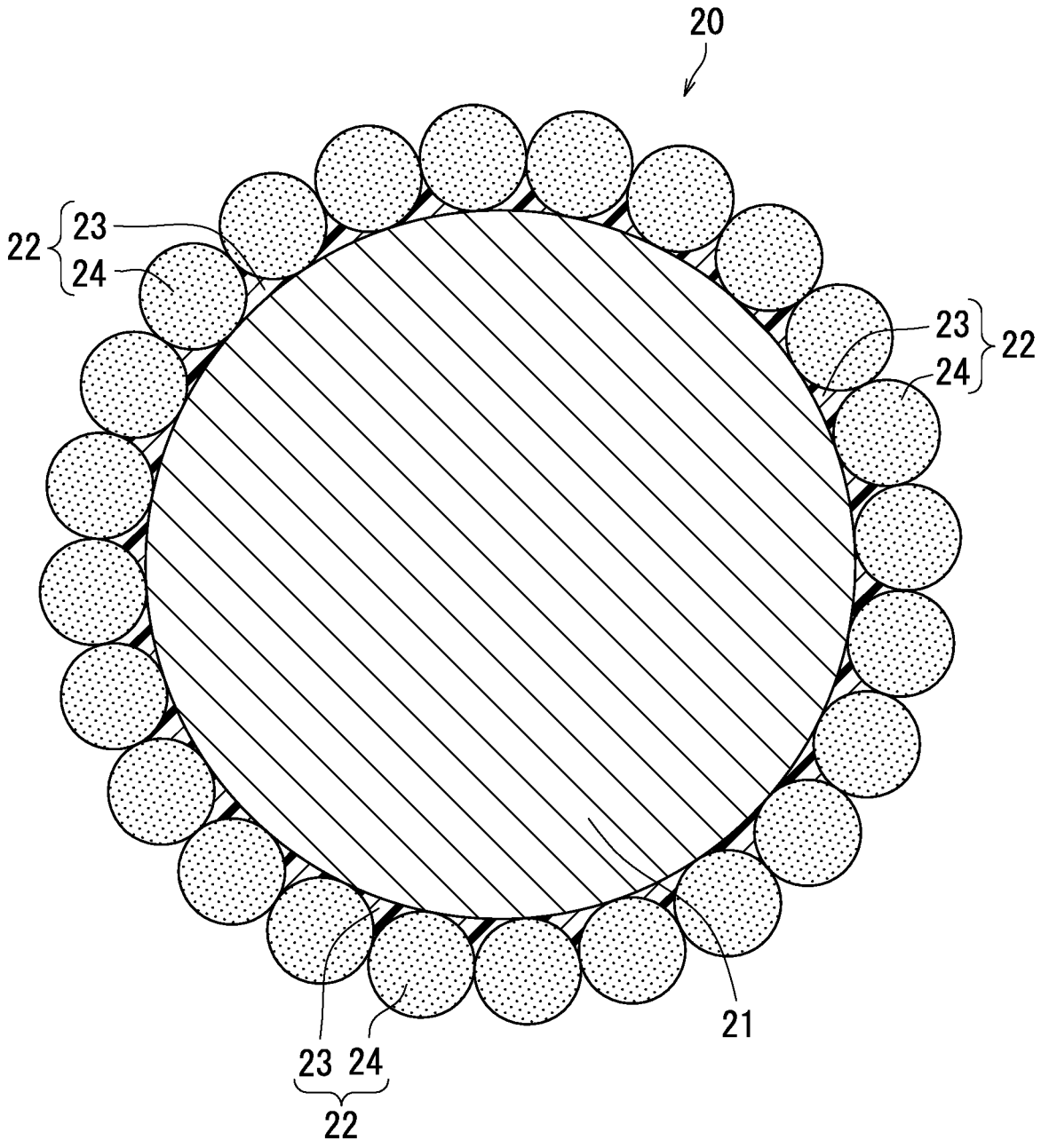
FIG. 2 is a diagram illustrating an example of a cross-sectional structure of a second carrier particle included in the carrier according to the first embodiment of the present disclosure.

FIG. 1 illustrates an example of a cross-sectional structure of a representative one of the first carrier particles included in the carrier according to the first embodiment. FIG. 2 illustrates an example of a cross-sectional structure of a representative one of the second carrier particles included in the carrier according to the first embodiment.

As illustrated in FIG. 1, a first carrier particle 10 includes a first carrier core 11 and a first coat layer 12 covering a surface of the first carrier core 11.

In order to achieve satisfactory developing ability, the first coat layers 12 preferably have a thickness of at least 700 nm and no greater than 1,000 nm, more preferably at least 900 nm and no greater than 1,000 nm, and still more preferably at least 950 nm and no greater than 1,000 nm. The thickness of the first coat layers 12 is measured according to the same method as described below in association with Examples or a method conforming therewith.

In order to achieve satisfactory developing ability, each first coat layer 12 preferably covers at least 90% and no greater than 100% of an surface area of the corresponding first carrier core 11.

In order to achieve satisfactory developing ability, the first carrier cores 11 preferably have a volume median diameter ($D_{50}$) of at least 15 μm and no greater than 150 μm, and more preferably at least 20 μm and no greater than 100 μm.

In order to achieve satisfactory developing ability, a saturation magnetization of the first carrier cores 11 in an applied magnetic field of 3,000 ($10^3/4\pi \cdot A/m$) is preferably at least 30 $A \cdot m^2/kg$ and no greater than 90 $A \cdot m^2/kg$, and more preferably at least 40 $A \cdot m^2/kg$ and no greater than 80 $A \cdot m^2/kg$.

As illustrated in FIG. 2, a second carrier particle 20 includes a second carrier core 21 and a second coat layer 22 covering a surface of the second carrier core 21. The second coat layers 22 contain a coat layer binder resin 23 and a fatty acid metal salt 24. The second coat layers 22 contain the fatty acid metal salt 24 in a proportion of at least 85% by mass and no greater than 95% by mass relative to a total mass of the second coat layers 22. In order to facilitate supply of the fatty acid metal salt 24 to an image bearing member (not shown), the fatty acid metal salt 24 is preferably exposed at a surface of each second coat layer 22 as illustrated in FIG. 2. Note that the fatty acid metal salt 24 is in the form of spherical particles in FIG. 2, but the fatty acid metal salt 24 in the carrier according to the first embodiment may be in any other form (more specific examples include plate-shaped particles and needle-shaped particles).

In order to further reduce the variation in amount of charge of the toner before and after printing on a large number of sheets while further suppressing occurrence of image flow, the second coat layers 22 preferably have a thickness of at least 700 nm and no greater than 1,000 nm, more preferably at least 900 nm and no greater than 1,000 nm, and still more preferably at least 950 nm and no greater than 1,000 nm. The thickness of the second coat layers 22 is measured according to the same method as described below in association with Examples or a method conforming therewith.

In order to further suppress occurrence of image flow, each second coat layer 22 preferably covers at least 90% and no greater than 100% of the surface area of the corresponding second carrier core 21.

In order to further reduce the variation in amount of charge of the toner before and after printing on a large number of sheets while further suppressing occurrence of image flow, the second carrier cores 21 preferably have a volume median diameter ($D_{50}$) of at least 15 μm and no greater than 150 μm, and more preferably at least 20 μm and no greater than 100 μm.

The second carrier particles 20 are contained in a proportion of at least 7% by mass and no greater than 15% by mass relative to a total mass of the first carrier particles 10 and the second carrier particles 20.

Through the above, an example of the composition of the carrier particles included in the carrier according to the first embodiment has been described with reference to FIGS. 1 and 2.

[Elements of Carrier Particles]

The following describes elements of the carrier particles included in the carrier according to the first embodiment.

{First Carrier Particles}

First, the first carrier particles will be described.

(First Carrier Cores)

The first carrier cores preferably contain a magnetic material. The first carrier cores may be particles of a magnetic material or carrier cores including a carrier core binder resin and particles of a magnetic material dispersed in the carrier core binder resin (also referred to below as resin carrier cores).

Examples of magnetic materials that can be contained in the first carrier cores include ferromagnetic metals (specific examples include iron, cobalt, nickel, and alloys including at least one of these metals) and ferromagnetic metal oxides (specific examples include ferrite). Examples of preferable ferrites include Ba ferrite, Mn ferrite, Mn—Zn ferrite, Ni—Zn ferrite, Mn—Mg ferrite, Ca—Mg ferrite, Li ferrite, Cu—Zn ferrite, and Mn—Mg—Sr ferrite. Examples of preferable ferromagnetic metal oxides include magnetite, which is a type of spinel ferrite. One magnetic material may be used independently, or two or more magnetic materials may be used in combination as a material of the first carrier cores. Examples of methods for preparing the first carrier cores include a method involving pulverizing and baking a magnetic material. Note that a commercially available product may be used as the first carrier cores.

In a situation in which the first carrier cores are particles of a magnetic material, examples of preferable particles of a magnetic material include ferrite particles (ferrite cores). Ferrite particles tend to have magnetic properties sufficient for image formation.

In a situation in which the first carrier cores are resin carrier cores, the carrier core binder resin contained in the resin carrier cores is preferably at least one resin selected from the group consisting of polyester resins, urethane resins, and phenolic resins. More preferably, the carrier core binder resin is a phenolic resin. Examples of particles of a magnetic material dispersed in the carrier core binder resin include particles including at least one magnetic material selected from the magnetic materials listed as examples above.

(First Coat Layers)

The first coat layers contain no fatty acid metal salt. The first coat layers are for example composed of a resin. Either a thermoplastic resin or a thermosetting resin may be used to compose the first coat layers. Alternatively, a combination of a thermoplastic resin and a thermosetting resin may be used. Note that the first coat layers may contain an additive. Examples of additives that can be used include carbon black for adjustment of electrical resistivity of the first coat layers.

Examples of thermoplastic resins that can be used to compose the first coat layers include fluororesins, polystyrenes, acrylic resins, styrene-acrylate copolymers, styrene-butadiene copolymers, ethylene-vinyl acetate copolymers, polyvinyl chloride, polyvinyl acetate, polyvinyl alcohol, polyvinyl acetal, polyvinylpyrrolidone, novolac resins, low molecular weight polyethylenes, aliphatic polyester resins, polyethylene terephthalate, polybutylene terephthalate, aromatic polyester resins (specific examples include polyarylate), polyamide resins, polyacetal resins, polycarbonate resins, polyethersulfone resins, polysulfone resins, polyphenylene sulfide resins, and polyetherketone resins.

Examples of thermosetting resins that can be used to compose the first coat layers include silicone resins, phenolic resins, modified phenolic resins, alkyd resins, epoxy resins, unsaturated polyester resins, urea resins, melamine resins, urea-melamine resins, guanamine resins, acetoguanamine resins, furane resins, and thermosetting polyamide-imide resins.

In order to achieve satisfactory developing ability, the resin for composing the first coat layers is preferably at least one resin selected from the group consisting of silicone resins and thermosetting polyamide-imide resins. More preferably, the resin for composing the first coat layers is a silicone resin.

{Preparation Method of First Carrier Particles}

The following describes a preferable method for preparing the first carrier particles. First, the first carrier cores in a fluidized bed are sprayed with a liquid containing a material of the first coat layers (also referred to below as a first coat liquid) using a flow coating device. The thickness of the first coat layers to be obtained can be adjusted for example by changing at least one of the concentration of the material in the first coat liquid and the amount of the first coat liquid being sprayed.

Next, the first carrier cores covered with the first coat liquid are subjected to a thermal treatment to give a powder of the first carrier particles including the first carrier cores and the first coat layers covering the surfaces of the first carrier cores.

{Second Carrier Particles}

Next, the second carrier particles will be described.

(Second Carrier Cores)

Preferably, the second carrier cores contain a magnetic material. Examples of carrier cores that can be used as the second carrier cores include the carrier cores described above as specific examples of the first carrier cores. The second carrier cores of the carrier according to the first embodiment may be the same carrier cores as the first carrier cores or may be carrier cores different from the first carrier cores.

(Second Coat Layers)

The second coat layers contain a coat layer binder resin (also referred to below as a coat resin) and a fatty acid metal salt. Note that the second coat layers may be composed only of a coat resin and a fatty acid metal salt or may contain an additive in addition to a coat resin and a fatty acid metal salt. Examples of additives that can be used include carbon black for adjustment of electrical resistivity of the second coat layers.

Examples of coat resins that can be used include the resins listed above as specific examples of resins that can be used to compose the first coat layers. The coat resin in the second coat layers of the carrier according to the first embodiment may be the same as the resin composing the first coat layers or may be different from the resin composing the first coat layers.

In order to further reduce the variation in amount of charge of the toner before and after printing on a large number of sheets while further suppressing occurrence of image flow, the coat resin is preferably at least one resin selected from the group consisting of silicone resins and thermosetting polyamide-imide resins. More preferably, the coat resin is a silicone resin.

The fatty acid metal salt contained in the second coat layers is for example a metal salt of monovalent carboxylic acid having a hydrocarbon group. In order to further reduce the variation in amount of charge of the toner before and after printing on a large number of sheets while further suppressing occurrence of image flow, the fatty acid metal salt is preferably a fatty acid metal salt having a carbon number of at least 10 and no greater than 20, and more preferably a fatty acid metal salt having a carbon number of at least 16 and no greater than 18.

Examples of fatty acid metal salts having a carbon number of at least 16 and no greater than 18 include metal stearates such as zinc stearate, aluminum stearate, copper stearate, magnesium stearate, and calcium stearate; metal oleates such as zinc oleate, manganese oleate, iron oleate, copper oleate, and magnesium oleate; metal palmitates such as zinc palmitate, copper palmitate, magnesium palmitate, and calcium palmitate; and metal linoleates such as zinc linoleate and calcium linoleate.

In order to further suppress occurrence of image flow, the fatty acid metal salt is preferably a metal stearate, and more preferably at least one metal stearate selected from the group consisting of zinc stearate and calcium stearate.

(Combination of Materials)

In order to further reduce the variation in amount of charge of the toner before and after printing on a large number of sheets while further suppressing occurrence of image flow, preferably, the coat resin is at least one resin selected from the group consisting of silicone resins and thermosetting polyamide-imide resins, and the fatty acid metal salt is at least one metal stearate selected from the group consisting of zinc stearate and calcium stearate. For the same purpose, more preferably, the coat resin is at least one resin selected from the group consisting of silicone resins and thermosetting polyamide-imide resins, the fatty acid metal salt is at least one metal stearate selected from the group consisting of zinc stearate and calcium stearate, and the second coat layers have a thickness of at least 950 nm and no greater than 1,000 nm. For the same purpose, further preferably, the coat resin is a silicone resin, the fatty acid metal salt is zinc stearate, and the second coat layers have a thickness of at least 950 nm and no greater than 1,000 nm.

{Preparation Method of Second Carrier Particles}

The following describes a preferable method for preparing the second carrier particles. First, the second carrier cores in a fluidized bed are sprayed with a liquid containing a material of the second coat layers (also referred to below as a second coat liquid) using a flow coating device. The second coat liquid contains a coat resin (or a coat resin precursor) and a fatty acid metal salt. The thickness of the second coat layers to be obtained can be adjusted for example by changing at least one of the concentration of any of the materials in the second coat liquid and the amount of the second coat liquid being sprayed onto the second carrier cores. Furthermore, the fatty acid metal salt content relative to the total mass of the second coat layers to be obtained can be adjusted by changing the concentration of the fatty acid metal salt in the second coat liquid.

Next, the second carrier cores covered with the second coat liquid are subjected to a thermal treatment to give a powder of the second carrier particles including the second carrier cores and the second coat layers covering the surfaces of the second carrier cores.

[Production Method of Carrier]

Examples of methods for producing the carrier according to the first embodiment include a method involving stirring and thus mixing the first carrier particles and the second carrier particles using a mixer (specific examples include a ball mill and ROCKING MIXER (registered Japanese trademark)). Through such a method, the carrier including the first carrier particles and the second carrier particles is obtained.

Second Embodiment: Two-component Developer

The following describes a two-component developer according to a second embodiment of the present disclosure. The two-component developer (also referred to below simply as a developer) according to the second embodiment includes a toner and the carrier according to the first embodiment described above. Description is omitted for aspects that are the same as in the first embodiment described above.

The toner included in the developer includes toner particles. The toner included in the developer can for example be used as a positively chargeable toner. The positively chargeable toner is positively charged through friction with the carrier.

The toner particles included in the toner may include an external additive. In the case of the toner particles including an external additive, the toner particles each include a toner mother particle and the external additive. The external additive adheres to a surface of the toner mother particle. No particular limitations are placed on the composition of the toner mother particles. The external additive may be omitted if not required. In the case of the toner particles including no external additive, the toner mother particles are equivalent to the toner particles.

In order to impart excellent fluidity to the toner whose toner particles include an external additive, it is preferable to use inorganic particles having a number average primary particle diameter of at least 5 nm and no greater than 30 nm as external additive particles. In order that the external additive functions as a spacer between the toner particles to impart excellent heat-resistant preservability to the toner, it is preferable to use resin particles having a number average primary particle diameter of at least 50 nm and no greater than 200 nm as the external additive particles. In order to allow the external additive to sufficiently exhibit its function while inhibiting detachment of the external additive from the toner mother particles, an amount of the external additive is preferably at least 1 part by mass and no greater than 10 parts by mass relative to 100 parts by mass of the toner mother particles.

The toner particles may be toner particles including no shell layers (non-capsule toner particles) or may be toner particles including shell layers (capsule toner particles). The capsule toner particles each include a toner mother particle including a toner core and a shell layer covering a surface of the toner core. No particular limitations are placed on the composition of the toner cores. The shell layers may be composed substantially only of a thermosetting resin, may be composed substantially only of a thermoplastic resin, or may contain both a thermoplastic resin and a thermosetting resin.

In order to obtain a toner suitable for image formation, the toner mother particles preferably have a volume median diameter ($D_{50}$) of at least 4 μm and no greater than 9 μm.

The developer according to the second embodiment can for example be obtained by stirring and thus mixing the carrier according to the first embodiment and the toner using a mixer (specific examples include a ball mill and ROCKING MIXER (registered Japanese trademark)). The toner particles are preferably blended in an amount of at least 1 part by mass and no greater than 20 parts by mass relative to 100 parts by mass of the carrier particles, and more preferably in an amount of at least 3 parts by mass and no greater than 15 parts by mass. Note that the developer according to the second embodiment can alternatively be obtained by stirring and thus mixing a powder of the first carrier particles, a powder of the second carrier particles, and a powder of the toner particles (toner) at the same time.

The developer according to the second embodiment described above includes the carrier according to the first embodiment, and can therefore reduce the variation in amount of charge of the toner before and after printing on a large number of sheets while suppressing occurrence of image flow.

EXAMPLES

The following describes Examples of the present disclosure. However, the present disclosure is not in any way limited to the scope of Examples.

<Preparation of Carrier Particles>

The following describes methods for preparing carrier particles C1A, carrier particles C2A-1 to C2A-6, and carrier particles C2B-1 and C2B-2. Note that in the following description, coat layers containing no fatty acid metal salt are "first coat layers" and coat layers containing a fatty acid metal salt are "second coat layers".

[Preparation of Carrier Particles C1A]

Ferrite cores ("EF-35B", product of Powdertech Co., Ltd., volume median diameter ($D_{50}$): 35 μm, saturation magnetization in an applied magnetic field of 3,000 ($10^3/4\pi \cdot A/m$): 68 $A \cdot m^2/kg$) were prepared as carrier cores. Also, as a liquid containing a material of the first coat layers (first coat liquid), a solution having a solid concentration of 20% by mass was prepared by diluting a thermosetting silicone resin ("KR-220L", product of Shin-Etsu Chemical Co., Ltd., curing start temperature: 170° C.) with toluene. Into a tumbling fluidized bed coater ("MULTIPLEX MP-01", product of Powrex Corporation), 100 parts by mass of the ferrite cores were added, and 20 parts by mass of the first coat liquid was sprayed to the ferrite cores being fluidized.

Subsequently, the ferrite cores covered with the first coat liquid were subjected to a thermal treatment at a temperature of 190° C. for 2 hours to give a powder of the carrier particles C1A including the ferrite cores and the first coat layers (layers composed of the silicone resin) each covering an entire surface area of the corresponding ferrite core. The carrier particles C1A had a first coat layer thickness of 950 nm. The first coat layer thickness of the carrier particles C1A was measured according to a method described below.

[Measurement Method of First Coat Layer Thickness]

The powder of the carrier particles C1A was dispersed in a cold-setting epoxy resin, and then the resultant dispersion was caused to harden for two days in an atmosphere at a temperature of 40° C. to obtain a hardened product. Subsequently, the hardened product was cut using an ultramicrotome ("EM UC6", product of Leica Microsystems) including a diamond knife to obtain a flake sample. Subsequently, an image of a cross-section of the thus obtained flake sample (cross-sections of carrier particles C1A) was captured at a magnification of 10,000× using a field emission scanning electron microscope (FE-SEM, "JSM-7600F", product of JEOL Ltd.).

Subsequently, an image of a cross-section of a carrier particle C1A in the captured image was analyzed using image analysis software ("WinROOF", product of Mitani Corporation) to measure the thickness of the first coat layer. Specifically, two straight lines intersecting at right angles at approximately the center of the cross-section of the carrier particle C1A were drawn, and the thickness of the first coat layer was measured at four locations at which the two straight lines and the first coat layer intersected. An arithmetic mean of values of the thickness measured at the four locations was taken to be the first coat layer thickness of the carrier particle C1A. The first coat layer thickness was measured for ten carrier particles C1A in the powder of the measurement target carrier particles C1A, and a number average of the measured values of the thickness was taken to be an evaluation value (first coat layer thickness: 950 nm) of the measurement target carrier particles C1A.

[Preparation of Carrier Particles C2A-1]

Ferrite cores ("EF-35B", product of Powdertech Co., Ltd., volume median diameter ($D_{50}$): 35 μm, saturation magnetization in an applied magnetic field of 3,000 ($10^3/4\pi \cdot A/m$): 68 $A \cdot m^2/kg$) were prepared as carrier cores. Also, as a liquid containing materials of the second coat layers, a second coat liquid having a solid concentration of 20% by mass was prepared by adding zinc stearate (sold by FUJIFILM Wako Pure Chemical Corporation, seller's code: 263-00391) to the first coat liquid that was used for the preparation of the carrier particles C1A and diluting the resultant solution with toluene. In the preparation of the second coat liquid, the zinc stearate was added in an amount of 90 parts by mass relative to 10 parts by mass of the solid of the first coat liquid. Into a tumbling fluidized bed coater ("MULTIPLEX MP-01", product of Powrex Corporation), 100 parts by mass of the ferrite cores were added, and 20 parts by mass of the second coat liquid was sprayed to the ferrite cores being fluidized.

Subsequently, the ferrite cores covered with the second coat liquid were subjected to a thermal treatment at a temperature of 190° C. for 2 hours to give a powder of the carrier particles C2A-1 including the ferrite cores and the second coat layers (layers composed of the silicone resin as a coat resin and the zinc stearate as a fatty acid metal salt) each covering an entire surface area of the corresponding ferrite core. The second coat layers of the carrier particles C2A-1 had a zinc stearate content of 90% by mass relative to the total mass of the second coat layers. The carrier particles C2A-1 had a second coat layer thickness of 1,000 nm. The second coat layer thickness of the carrier particles C2A-1 was measured according to the same method as the above-described measurement method of the first coat layer thickness. The second coat layer thickness was measured also for the later-described carrier particles C2A-2 to C2A-6 and the carrier particles C2B-1 and C2B-2 according to the same method as the measurement method of the first coat layer thickness.

[Preparation of Carrier Particles C2A-2]

A powder of the carrier particles C2A-2 was obtained according to the same method as the preparation method of the carrier particles C2A-1 in all aspects other than the following changes. The carrier particles C2A-2 had a second coat layer thickness of 980 nm.

(Changes)

In the preparation of the carrier particles C2A-2, an application liquid A1 having a solid concentration of 20% by mass was used as the second coat liquid. The application liquid A1 was prepared by adding zinc stearate (sold by FUJIFILM Wako Pure Chemical Corporation, seller's code: 263-00391) to a silicone resin solution ("SR2431", product of Dow Corning Toray Co., Ltd., curing start temperature: 220° C.), and then diluting the resultant solution with toluene. In the preparation of the application liquid A1, the zinc stearate was added in an amount of 90 parts by mass relative to 10 parts by mass of the solid of the silicone resin solution ("SR2431", product of Dow Corning Toray Co., Ltd.). Also, in the preparation of the carrier particles C2A-2, ferrite cores covered with the application liquid A1 were subjected to a thermal treatment at a temperature of 260° C. for 1 hour.

[Preparation of Carrier Particles C2A-3]

A powder of the carrier particles C2A-3 was obtained according to the same method as the preparation method of the carrier particles C2A-1 in all aspects other than the following changes. The carrier particles C2A-3 had a second coat layer thickness of 980 nm.

(Changes)

In the preparation of the carrier particles C2A-3, an application liquid A2 having a solid concentration of 20% by mass was used as the second coat liquid. The application liquid A2 was prepared by adding zinc stearate (sold by FUJIFILM Wako Pure Chemical Corporation, seller's code: 263-00391) to a thermosetting polyamide-imide resin solution, and then diluting the resultant solution with dimethyl sulfoxide. As the thermosetting polyamide-imide resin solution, "COMPOCERAN (registered Japanese trademark) H901-2" (curing start temperature: 240° C.), product of Arakawa Chemical Industries, Ltd. was used. In the preparation of the application liquid A2, the zinc stearate was added in an amount of 90 parts by mass relative to 10 parts by mass of the solid of the thermosetting polyamide-imide resin solution ("COMPOCERAN (registered Japanese trademark) H901-2", product of Arakawa Chemical Industries, Ltd.). Also, in the preparation of the carrier particles C2A-3, ferrite cores covered with the application liquid A2 were subjected to a thermal treatment at a temperature of 260° C. for 1 hour.

[Preparation of Carrier Particles C2A-4]

A powder of the carrier particles C2A-4 was obtained according to the same method as the preparation method of the carrier particles C2A-1 in all aspects other than the following changes. The carrier particles C2A-4 had a second coat layer thickness of 1,000 nm.

(Changes)

In the preparation of the carrier particles C2A-4, an application liquid A3 having a solid concentration of 20% by mass was used as the second coat liquid. The application liquid A3 was prepared by adding calcium stearate (sold by FUJIFILM Wako Pure Chemical Corporation, seller's code: 030-00905) to the first coat liquid that was used for the preparation of the carrier particles C1A, and then diluting the resultant solution with toluene. In the preparation of the application liquid A3, the calcium stearate was added in an amount of 90 parts by mass relative to 10 parts by mass of the solid of the first coat liquid.

[Preparation of Carrier Particles C2A-5]

A powder of the carrier particles C2A-5 was obtained according to the same method as the preparation method of the carrier particles C2A-1 in all aspects other than that the amount of the zinc stearate added in the preparation of the second coat liquid was changed to 95 parts by mass relative to 5 parts by mass of the solid of the first coat liquid. The carrier particles C2A-5 had a second coat layer thickness of 980 nm. [Preparation of Carrier Particles C2A-6]

A powder of the carrier particles C2A-6 was obtained according to the same method as the preparation method of the carrier particles C2A-1 in all aspects other than that the amount of the zinc stearate added in the preparation of the second coat liquid was changed to 85 parts by mass relative to 15 parts by mass of the solid of the first coat liquid. The carrier particles C2A-6 had a second coat layer thickness of 960 nm.

[Preparation of Carrier Particles C2B-1]

A powder of the carrier particles C2B-1 was obtained according to the same method as the preparation method of the carrier particles C2A-1 in all aspects other than that the amount of the zinc stearate added in the preparation of the second coat liquid was changed to 97 parts by mass relative to 3 parts by mass of the solid of the first coat liquid. The carrier particles C2B-1 had a second coat layer thickness of 980 nm.

[Preparation of Carrier Particles C2B-2]

A powder of the carrier particles C2B-2 was obtained according to the same method as the preparation method of the carrier particles C2A-1 in all aspects other than that the amount of the zinc stearate added in the preparation of the second coat liquid was changed to 83 parts by mass relative to 17 parts by mass of the solid of the first coat liquid. The carrier particles C2B-2 had a second coat layer thickness of 960 nm.

<Preparation of Evaluation Toner>

[Synthesis of Non-Crystalline Polyester Resin R-1]

A four-necked flask having a capacity of 10 L and equipped with a thermometer (a thermocouple), a drainage tube, a nitrogen inlet tube, and a stirrer was charged with 370 g of a bisphenol A propylene oxide adduct (average number of moles of propylene oxide added: 2 mol), 3,059 g of a bisphenol A ethylene oxide adduct (average number of moles of ethylene oxide added: 2 mol), 1,194 g of terephthalic acid, 286 g of fumaric acid, 10 g of tin(II) 2-ethylhexanoate, and 2 g of gallic acid. Subsequently, the flask contents were caused to react under a nitrogen atmosphere at a temperature of 230° C. until a reaction completion rate reached 90% by mass. The reaction completion rate was calculated in accordance with the following expression:

"reaction completion rate=100×actual amount of water generated by reaction/theoretical amount of water generated by reaction". Subsequently, the flask contents were caused to react under a reduced pressure atmosphere (pressure: 8.3 kPa) at a temperature of 230° C. until a reaction product (a resin) having a desired Tm (89° C.) was obtained. Through the above, a non-crystalline polyester resin R-1 was obtained. The non-crystalline polyester resin R-1 had a Tg of 50° C. and a Tm of 89° C.

[Synthesis of Non-crystalline Polyester Resin R-2]

A four-necked flask having a capacity of 10 L and equipped with a thermometer (a thermocouple), a drainage tube, a nitrogen inlet tube, and a stirrer was charged with 1,286 g of a bisphenol A propylene oxide adduct (average number of moles of propylene oxide added: 2 mol), 2,218 g of a bisphenol A ethylene oxide adduct (average number of moles of ethylene oxide added: 2 mol), 1,603 g of terephthalic acid, 10 g of tin(II) 2-ethylhexanoate, and 2 g of gallic acid. Subsequently, the flask contents were caused to react under a nitrogen atmosphere at a temperature of 230° C. until the reaction completion rate represented by the above expression reached 90% by mass. Subsequently, the flask contents were caused to react under a reduced pressure atmosphere (pressure: 8.3 kPa) at a temperature of 230° C. until a reaction product (a resin) having a desired Tm (111° C.) was obtained. Through the above, a non-crystalline polyester resin R-2 was obtained. The non-crystalline polyester resin R-2 had a Tg of 69° C. and a Tm of 111° C.

[Synthesis of Non-Crystalline Polyester Resin R-3]

A four-necked flask having a capacity of 10 L and equipped with a thermometer (a thermocouple), a drainage tube, a nitrogen inlet tube, and a stirrer was charged with 4,907 g of a bisphenol A propylene oxide adduct (average number of moles of propylene oxide added: 2 mol), 1,942 g of a bisphenol A ethylene oxide adduct (average number of moles of ethylene oxide added: 2 mol), 757 g of fumaric acid, 2,078 g of n-dodecylsuccinic anhydride, 30 g of tin(II) 2-ethylhexanoate, and 2 g of gallic acid. Subsequently, the flask contents were caused to react under a nitrogen atmosphere at a temperature of 230° C. until the reaction completion rate represented by the above expression reached 90% by mass. The flask contents were then caused to react for 1 hour under a reduced pressure atmosphere (pressure: 8.3 kPa) at a temperature of 230° C. Subsequently, 548 g of trimellitic anhydride was added into the flask, and the flask contents were caused to react under a reduced pressure atmosphere (pressure: 8.3 kPa) at a temperature of 220° C. until a reaction product (a resin) having a desired Tm (127° C.) was obtained. Through the above, a non-crystalline polyester resin R-3 was obtained. The non-crystalline polyester resin R-3 had a Tg of 51° C. and a Tm of 127° C.

[Synthesis of Crystalline Polyester Resin R-4]

A four-necked flask having a capacity of 10 L and equipped with a thermometer (a thermocouple), a drainage tube, a nitrogen inlet tube, and a stirrer was charged with 2,231 g of ethylene glycol, 5,869 g of suberic acid, 40 g of tin(II) 2-ethylhexanoate, and 3 g of gallic acid. Subsequently, the flask contents were caused to react for 4 hours under a nitrogen atmosphere at a temperature of 180° C., and then caused to react for 10 hours under a nitrogen atmosphere at a temperature of 210° C. Subsequently, the flask contents were caused to react for 1 hour under a reduced pressure atmosphere (pressure: 8.3 kPa) at a temperature of 210° C. Through the above, a crystalline polyester resin R-4 was obtained. The crystalline polyester resin R-4 had a Tm of 78° C. and an Mp of 74° C.

[Preparation of Toner Mother Particles]

An FM mixer ("FM-20B", product of Nippon Coke & Engineering Co., Ltd.) was used to mix 300 g of the non-crystalline polyester resin R-1, 100 g of the non-crystalline polyester resin R-2, 600 g of the non-crystalline polyester resin R-3, 100 g of the crystalline polyester resin R-4, 12 g of a first releasing agent ("CARNAUBA WAX No. 1", product of S. Kato & Co., ingredient: carnauba wax), 48 g of a second releasing agent ("NISSAN ELECTOL (registered Japanese trademark) WEP-3", product of NOF Corporation, ingredient: ester wax), 15 g of a charge control agent ("BONTRON (registered Japanese trademark) P-51", product of Orient Chemical Industries, Co., Ltd., ingredient: quaternary ammonium salt), and 144 g of a colorant ("COLORTEX (registered Japanese trademark) Blue B1021", product of SANYO COLOR WORKS, Ltd., ingredient: Phthalocyanine Blue) at a rotational speed of 2,400 rpm for 3 minutes.

Subsequently, the resultant mixture was melt-kneaded using a twin-screw extruder ("PCM-30", product of Ikegai Corp.) under conditions of a material feeding rate of 5 kg/hour, a shaft rotational speed of 160 rpm, and a cylinder temperature of 100° C. Thereafter, the resultant melt-kneaded product was cooled. After the cooling, the melt-kneaded product was coarsely pulverized using a pulverizer ("ROTOPLEX (registered Japanese trademark)", product of Hosokawa Micron Corporation). Subsequently, the resultant coarsely pulverized product was finely pulverized using a jet mill ("Model-I SUPER SONIC JET MILL", product of Nippon Pneumatic Mfg.). Subsequently, the resultant finely pulverized product was classified using a classifier ("ELBOW JET Type EJ-LABO", product of Nittetsu Mining Co., Ltd.) to obtain toner mother particles having a volume median diameter ($D_{50}$) of 6.8 μm.

[Addition of External Additive]

An FM mixer ("FM-10B", product of Nippon Coke & Engineering Co., Ltd.) was used to mix 100 parts by mass of the toner mother particles obtained as described above and 1.5 parts by mass of silica particles ("AEROSIL (registered Japanese trademark) REA90", product of Nippon Aerosil Co., Ltd.) for 5 minutes under conditions of a rotational speed of 3,000 rpm and a jacket temperature of 20° C. Thus, the external additive (silica particles) was caused to adhere to the surfaces of the toner mother particles.

Subsequently, sifting was performed on the resultant powder using a 200-mesh sieve (pore size: 75 μm). As a result, a positively chargeable evaluation toner (a powder of toner particles) was obtained. The composition ratio of the components of the toner did not change before and after the sifting.

<Preparation of Developer>

The following describes methods for preparing developers DA-1 to DA-8 and DB-1 to DB-4. Note that in the following description, "first carrier particles" mean carrier particles having first coat layers. Also, "second carrier particles" mean carrier particles having second coat layers.

[Preparation of Developer DA-1]

A ball mill was used to mix 90 parts by mass of the carrier particles C1A (first carrier particles) and 10 parts by mass of the carrier particles C2A-1 (second carrier particles) for 5 minutes to obtain an evaluation carrier. In the thus obtained evaluation carrier, the carrier particles C2A-1 (second carrier particles) were contained in a proportion of 10% by mass relative to a total mass of the carrier particles C1A (first carrier particles) and the carrier particles C2A-1 (second carrier particles).

Next, a ball mill was used to mix 100 parts by mass of the evaluation carrier obtained as described above and 6 parts by mass of the evaluation toner obtained as described above for 30 minutes to give the developer DA-1.

[Preparation of Developers DA-2 to DA-8 and DB-1 to DB-4]

Each of the developers DA-2 to DA-8 and DB-1 to DB-4 was obtained according to the same method as the preparation method of the developer DA-1 in all aspects other than that the second carrier particles and the second carrier particle content relative to the total mass of the first carrier particles and the second carrier particles as shown in Table 1 described below were employed. Note that the mixing ratio by mass between the evaluation carrier and the evaluation toner (evaluation carrier:evaluation toner) was 100:6 in all of the developers DA-2 to DA-8 and DB-1 to DB-4 prepared as described above.

<Evaluation Methods>

[Image Flow]

A color multifunction peripheral ("TASKalfa 5052ci", product of KYOCERA Document Solutions Inc.) was used as an evaluation apparatus. With respect to each of the developers (evaluation targets: developers DA-1 to DA-8 and DB-1 to DB-4), the developer was loaded into a cyan-color developing device of the evaluation apparatus, and the evaluation toner (evaluation toner obtained as described above) was loaded into a cyan-color toner container of the evaluation apparatus. Next, an image having a coverage of 1% was printed on 100,000 successive sheets of printing paper (A4 size plain paper) using the evaluation apparatus under environmental conditions of a temperature of 20° C. and a relative humidity of 65%. After the printing, the evaluation apparatus was left to stand for 12 hours under environmental conditions of a temperature of 32.5° C. and a relative humidity of 80%.

Next, the evaluation apparatus that had been left to stand for 12 hours was used to output a halftone image (image density: 50%) onto an entire surface of a sheet of printing paper (A4 size plain paper) under environmental conditions of a temperature of 32.5° C. and a relative humidity of 80%. Next, the output image was visually observed, and thus the developer was evaluated in accordance with the following standard.

(Evaluation Standard)

A (Good): The output halftone image was not blurred, and image flow was not observed.

B (Bad): The output halftone image was blurred due to image flow.

[Charge Amount Variation Rate]

A color multifunction peripheral ("TASKalfa 5052ci", product of KYOCERA Document Solutions Inc.) was used as an evaluation apparatus. With respect to each of the developers (evaluation targets: developers DA-1 to DA-8 and DB-1 to DB-4), the developer was loaded into a cyan-color developing device of the evaluation apparatus, and the evaluation toner (evaluation toner obtained as described above) was loaded into a cyan-color toner container of the evaluation apparatus. Next, an image having a coverage of 1% was printed on 100,000 successive sheets of printing paper (A4 size plain paper) using the evaluation apparatus under environmental conditions of a temperature of 20° C. and a relative humidity of 65%.

During this continuous printing, the developer adhering to a development sleeve of the developing device of the evaluation apparatus was collected and the amount of charge (unit: μC/g) of the toner in the collected developer was measured using a compact draw-off charge measurement system ("MODEL 212HS", product of TREK, INC.) under environmental conditions of a temperature of 20° C. and a relative humidity of 65%. The measurement was performed when the printing on the first sheet was finished and when the printing on the 100,000th sheet was finished. The amount of charge measured when the printing on the first sheet was finished is referred to below as an "initial charge amount E1" (or simply as "E1"). The amount of charge measured when the printing on the 100,000th sheet was finished is referred to below as a "post-continuous printing charge amount E2" (or simply as "E2").

The charge amount variation rate (unit: %) was determined in accordance with the following expression using the initial charge amount E1 and the post-continuous printing charge amount E2 obtained as described above. Note that |E1−E2| in the following expression represents an absolute value of a difference calculated by subtracting E2 from E1.

$$\text{Charge amount variation rate} = 100 \times |E1 - E2| / E1$$

The developer was evaluated as A (being able to reduce the variation in amount of charge of the toner before and after printing on a large number of sheets) if the charge amount variation rate was less than 20%. The developer was evaluated as B (being unable to reduce the variation in amount of charge of the toner before and after printing on a large number of sheets) if the charge amount variation rate was greater than or equal to 20%.

<Evaluation Results>

Table 1 shows details of the second carrier particles, the second carrier particle content, results of the image flow evaluation, and results of the charge amount variation rate evaluation with respect to the developers DA-1 to DA-8 and DB-1 to DB-4. Note that in Table 1, "KR-220L" means the thermosetting silicone resin ("KR-220L", product of Shin-Etsu Chemical Co., Ltd.), "SR2431" means the silicone resin solution ("SR2431", product of Dow Corning Toray Co., Ltd.), and "H901-2" means the thermosetting polyamide-imide resin solution ("COMPOCERAN (registered Japanese trademark) H901-2", product of Arakawa Chemical Industries, Ltd.). In Table 1, "ZnSt" means zinc stearate, and "CaSt" means calcium stearate. In Table 1, the fatty acid metal salt content means the fatty acid metal salt content (unit: % by mass) relative to the total mass of the second coat layers. In Table 1, the second carrier particle content means the second carrier particle content (unit: % by mass) relative to the total mass of the first carrier particles and the second carrier particles.

TABLE 1

| | | Details of second carrier particles | | | | | | Charge |
|---|---|---|---|---|---|---|---|---|
| | Developer | Type | Resin (or resin solution) used in second coat liquid | Fatty acid metal salt | Fatty acid metal salt content [% by mass] | Second carrier particle content [% by mass] | Image flow | amount variation rate |
| Example 1 | DA-1 | C2A-1 | KR-220L | ZnSt | 90 | 10 | A | A |
| Example 2 | DA-2 | C2A-2 | SR2431 | ZnSt | 90 | 10 | A | A |
| Example 3 | DA-3 | C2A-3 | H901-2 | ZnSt | 90 | 10 | A | A |
| Example 4 | DA-4 | C2A-4 | KR-220L | CaSt | 90 | 10 | A | A |

TABLE 1-continued

| | Developer | Details of second carrier particles | | | | | Image flow | Charge amount variation rate |
|---|---|---|---|---|---|---|---|---|
| | | Type | Resin (or resin solution) used in second coat liquid | Fatty acid metal salt | Fatty acid metal salt content [% by mass] | Second carrier particle content [% by mass] | | |
| Example 5 | DA-5 | C2A-5 | KR-220L | ZnSt | 95 | 10 | A | A |
| Example 6 | DA-6 | C2A-6 | KR-220L | ZnSt | 85 | 10 | A | A |
| Example 7 | DA-7 | C2A-1 | KR-220L | ZnSt | 90 | 15 | A | A |
| Example 8 | DA-8 | C2A-1 | KR-220L | ZnSt | 90 | 7 | A | A |
| Comparative Example 1 | DB-1 | C2B-1 | KR-220L | ZnSt | 97 | 10 | B | B |
| Comparative Example 2 | DB-2 | C2B-2 | KR-220L | ZnSt | 83 | 10 | B | A |
| Comparative Example 3 | DB-3 | C2A-1 | KR-220L | ZnSt | 90 | 17 | A | B |
| Comparative Example 4 | DB-4 | C2A-1 | KR-220L | ZnSt | 90 | 5 | B | A |

In each of the developers DA-1 to DA-8, the second coat layers contained a coat resin and a fatty acid metal salt (a metal stearate). As shown in Table 1, the fatty acid metal salt content of each of the developers DA-1 to DA-8 was from 85% by mass to 95% by mass. The second carrier particle content of each of the developers DA-1 to DA-8 was from 7% by mass to 15% by mass.

As shown in Table 1, the developers DA-1 to DA-8 were evaluated as A in the image flow evaluation. That is, the developers DA-1 to DA-8 were able to suppress occurrence of image flow. The developers DA-1 to DA-8 were evaluated as A in the charge amount variation rate evaluation. That is, the developers DA-1 to DA-8 were able to reduce the variation in amount of charge of the toner before and after printing on a large number of sheets.

As shown in Table 1, the fatty acid metal salt content of the developer DB-1 was greater than 95% by mass. The fatty acid metal salt content of the developer DB-2 was less than 85% by mass. The second carrier particle content of the developer DB-3 was greater than 15% by mass. The second carrier particle content of the developer DB-4 was less than 7% by mass.

As shown in Table 1, the developers DB-1, DB-2, and DB-4 were evaluated as B in the image flow evaluation. That is, the developers DB-1, DB-2, and DB-4 were unable to suppress occurrence of image flow. The developers DB-1 and DB-3 were evaluated as B in the charge amount variation rate evaluation. That is, the developers DB-1 and DB-3 were unable to reduce the variation in amount of charge of the toner before and after printing on a large number of sheets.

These results indicate that according to the present disclosure, it is possible to reduce the variation in amount of charge of the toner before and after printing on a large number of sheets while suppressing occurrence of image flow.

What is claimed is:

1. A carrier comprising carrier particles, wherein the carrier particles include first carrier particles and second carrier particles, the first carrier particles each include a first carrier core and a first coat layer covering a surface of the first carrier core, the second carrier particles each include a second carrier core and a second coat layer covering a surface of the second carrier core, the first coat layers contain no fatty acid metal salt, the second coat layers contain a coat layer binder resin and a fatty acid metal salt, the second coat layers contain the fatty acid metal salt in a proportion of at least 85% by mass and no greater than 95% by mass relative to a total mass of the second coat layers, and the second carrier particles are contained in a proportion of at least 7% by mass and no greater than 15% by mass relative to a total mass of the first carrier particles and the second carrier particles.

2. The carrier according to claim 1, wherein the fatty acid metal salt has a carbon number of at least 10 and no greater than 20.

3. The carrier according to claim 2, wherein the fatty acid metal salt is a metal stearate.

4. The carrier according to claim 1, wherein the coat layer binder resin is at least one resin selected from the group consisting of silicone resins and thermosetting polyamide-imide resins.

5. The carrier according to claim 1, wherein the second coat layers have a thickness of at least 700 nm and no greater than 1,000 nm.

6. A two-component developer comprising:

a toner including toner particles; and the carrier according to claim 1.

* * * * *